US005690716A

United States Patent [19]

Sampath

[11] Patent Number: 5,690,716

[45] Date of Patent: Nov. 25, 1997

[54] THERMAL SPRAY POWDER

[75] Inventor: Sanjay Sampath, Setauket, N.Y.

[73] Assignee: Osram Sylvania Inc., Danvers, Mass.

[21] Appl. No.: 390,732

[22] Filed: Feb. 17, 1995

Related U.S. Application Data

[63] Continuation-in-part of Ser. No. 304,110, Sep. 9, 1994, abandoned.

[51] Int. Cl.[6] ..... C22B 19/03; B22F 1/00

[52] U.S. Cl. ..... 75/231; 75/236; 75/240; 75/252; 75/254; 75/255; 428/552

[58] Field of Search ..... 75/231, 236, 240, 75/252, 254, 255; 420/442, 452; 428/548, 551, 552, 565

[56] References Cited

U.S. PATENT DOCUMENTS

| | | | |
|---|---|---|---|
| 3,313,633 | 4/1967 | Longo | 106/1 |
| 3,837,817 | 9/1974 | Nakamura | 29/195 |
| 4,066,451 | 1/1978 | Rudy | 75/240 |
| 4,173,685 | 11/1979 | Weatherly | 428/556 |
| 4,592,964 | 6/1986 | Buran et al. | 428/610 |
| 4,597,939 | 7/1986 | Neuhauser et al. | 420/429 |
| 4,612,256 | 9/1986 | Neuhauser et al. | 428/547 |
| 4,713,685 | 12/1987 | Weatherly | 428/556 |
| 4,716,019 | 12/1987 | Hovck et al. | 419/17 |
| 4,756,841 | 7/1988 | Buran et al. | 252/26 |
| 5,063,021 | 11/1991 | Anand et al. | 419/12 |
| 5,419,976 | 5/1995 | Dulin | 428/570 |
| 5,421,852 | 6/1995 | Maruyama et al. | 75/239 |

FOREIGN PATENT DOCUMENTS

| | | | |
|---|---|---|---|
| 0605175A2 | 7/1994 | European Pat. Off. | C23C 4/06 |
| 3515107 | 7/1986 | Germany | C23C 4/06 |
| 3802920 | 5/1989 | Germany | C23C 4/04 |
| 1099957 | 1/1968 | United Kingdom | C23C 7/00 |

OTHER PUBLICATIONS

S. Sampath and S. Wayne, "Plasma Sprayed Mo–$Mo_2C$ Composites: Microstructure and Properties," *Proceedings of the 5th National Thermal Spray Conference,* Jun. 7–11, 1993, pp. 397–403.

U. Buran and M. Fischer, "Properties of Plasma Spray Coatings for Piston Ring Running Surfaces," *1st Plasma–Technik–Symposium,* May 18–20, 1988, v. 2, pp. 25–36.

H. Czichos et al., "Multilaboratory Tribotesting: Results From the Versailles Advanced Materials and Standards Programme on Wear Test Methods," *Wear,* v. 114 (1987) pp. 109–130.

Abstract, Derwent WPI, DE 3802920 (1988).

"ASM Handbook", vol. 7, Powder Metallurgy, 1984, pp. 823–833.

*Primary Examiner*—Charles T. Jordan
*Assistant Examiner*—Daniel Jenkins
*Attorney, Agent, or Firm*—Robert F. Clark

[57] ABSTRACT

A thermal spray powder for producing high hardness, low friction, wear resistant coatings on friction surfaces, comprising a blend of an agglomerated molybdenum/dimolybdenum carbide powder and a self-fluxing NiCr-FeBSi alloy powder.

11 Claims, 3 Drawing Sheets

THERMAL SPRAY POWDER

CROSS-REFERENCES TO RELATED APPLICATIONS

This application is a continuation-in-part of application Ser. No. 08/304,110, filed Sep. 9, 1992 now abandoned the disclosure of which is incorporated by reference.

TECHNICAL FIELD

This invention relates to thermal spray powders. More particularly, this invention relates to thermal spray powders which are used to produce wear resistant coatings on sliding contact friction surfaces such as piston rings, cylinder liners, paper mill rolls, and gear boxes.

BACKGROUND ART

Blended powders of molybdenum and self-fluxing NiCrFeBSi alloys are plasma sprayed onto metal surfaces to produce wear resistant coatings. Typical applications include mechanical parts subject to contact sliding conditions such as the piston rings and cylinder liners of internal combustion engines. In general, these blends consist of spray dried or densified molybdenum powder and atomized NiCrFeBSi alloys. An example of this type of thermal spray powder is described in U.S. Pat. No. 3,313,633. Unfortunately, coatings made from these powders exhibit rapid degradation and increased friction coefficients once the wear process is initiated. In particular, the degradation of these coatings is accelerated by coating break out failures, e.g. coating particle pull out and delamination of coating layers. These types of failures lead to increased friction between contacting surfaces and hence increased wear. Oxidation of the molybdenum during spraying is believed to be a principal cause of these types of failures.

U.S. Pat. No. 4,597,939 to Neuhauser et al. describes using a thermal spray powder containing a blend of molybdenum, molybdenum carbide and 80/20 NiCr alloy powders to produce a tougher plasma sprayed coating which is less prone to coating break out. The NiCr alloy component is employed to increase the toughness of the coating and the molybdenum carbide to provide the wear resistance. However, because of the relatively low hardness of the NiCr alloy, these powders produce coatings having low hardness values and consequently less wear resistance than the coatings made with the self fluxing NiCrFeBSi alloys.

U.S. Pat. No. 5,063,021 describes a method for preparing a thermal spray powder in which a blend of molybdenum and self-fluxing alloy powders is pre-alloyed through sintering and plasma densification prior to plasma spraying. However, the thermal spray powders prepared by this method exhibit poor sprayability in piston ring applications, producing coatings which have considerable porosity and poor adhesion.

Thus, it would be a distinct advantage over the prior art to provide a thermal spray powder which would increase the resistance of thermal spray coatings to coating break out, while providing high wear resistance and retaining sprayability.

SUMMARY OF THE INVENTION

It is an object of this invention to obviate the disadvantages of the prior art.

It is another object of this invention to provide a thermal spray powder for making high hardness, low friction coatings which are not subject to rapid wear propagation due to coating delamination or particle pull out.

It is a further object of this invention to reduce oxidation of molybdenum during thermal spraying.

In accordance with one aspect of the present invention, there is provided a thermal spray powder comprising a blend of an agglomerated molybdenum/dimolybdenum carbide powder and a self-fluxing NiCrFeBSi alloy powder.

In accordance with another aspect of the present invention, there is provided a thermal spray powder comprising a blend of an agglomerated molybdenum/dimolybdenum carbide powder and a self-fluxing NiCrFeBSi alloy powder wherein the agglomerated molybdenum/dimolybdenum carbide powder has particles containing a uniformly distributed dimolybdenum carbide phase.

In accordance with a further aspect of the present invention, there is provided a coating comprising lamellae of molybdenum containing dimolybdenum carbide precipitates and lamellae of a self-fluxing NiCrFeBSi alloy, said lamellae being bonded together, said coating having a hardness of about 900 and containing less than about 10 vol. % dimolybdenum carbide.

DESCRIPTION OF THE PREFERRED EMBODIMENTS

For a better understanding of the present invention, together with other and further objects, advantages and capabilities thereof, reference is made to the following disclosure and appended claims taken in conjunction with the above-described drawings.

The present invention is a thermal spray powder consisting of a blend of an agglomerated molybdenum/dimolybdenum carbide powder and a self-fluxing NiCrFeBSi alloy powder. Thermal spraying of the powder produces high hardness, wear resistant coatings which maintain a low coefficient of friction under continuous sliding contact, are less susceptible to coating break out failures, and exhibit good sprayability. The coatings produced by plasma spraying these blended powders exhibit a microstructure which consists of thin layers, or lamellae, of molybdenum and NiCrFeBSi. The dual phase structure of these coatings results in the coating having a low friction coefficient, which is provided by the molybdenum lamellae, and good wear resistance, which is provided by the hard NiCrFeBSi lamellae. The molybdenum lamellae further contain dimolybdenum carbide precipitates which were not consumed during the plasma spraying. Typically, the amount of carbide in the resultant coating is less than 10 percent by volume.

It is believed that two of the principle causes of the coating break out failures of the Mo/NiCrFeBSi prior art coatings are the low strength of the molybdenum lamellae and the poor bonding between the molybdenum lamellae and the NiCrFeBSi lamellae. The poor interlamellae bonding is attributed to the presence of molybdenum oxide on the surface of the lamellae which occurs as a result of the plasma spraying. This invention solves the interlamellae bonding problem by significantly reducing the oxidation of molybdenum during spraying while simultaneously increasing the strength of the molybdenum lamellae and preserving the dual phase nature of the coating.

Figure 1:
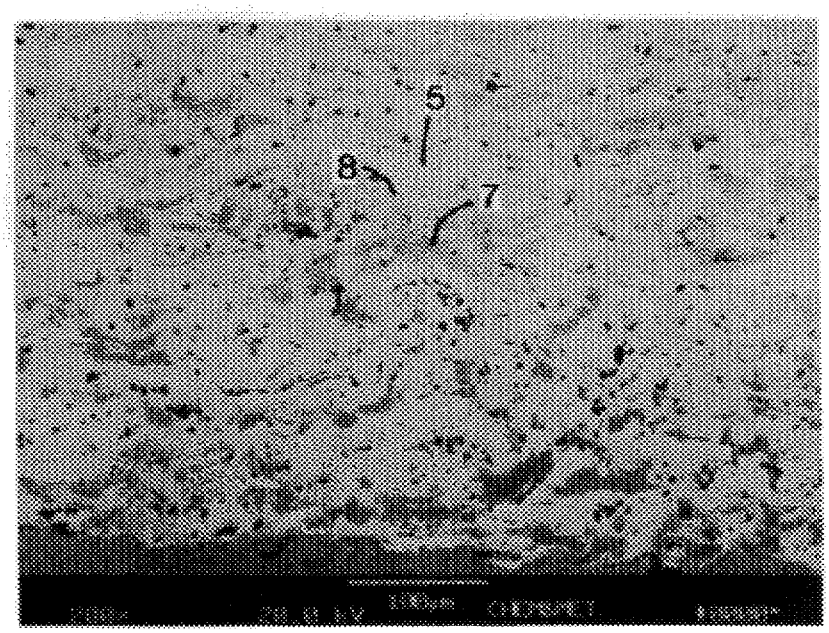
FIG. 1 is a Scanning Electron Microscope (SEM) photomicrograph of a cross-section of a coating produced by an embodiment of the thermal spray powder of this invention.

The dual phase nature of the coating can be seen in FIG. 1 which is an SEM photomicrograph of a cross section of a coating formed by plasma spraying the thermal spray powder of this invention. The photomicrograph clearly shows the two-phase structure which consists of molybdenum 5 (light phase) and NiCrFeBSi 7 (dark phase) lamellae The interfacial boundaries 8 between the molybdenum lamellae 5 and the NiCrFeBSi lamellae 7 are thought to be where delamination occurs due to oxidation of the molybdenum during plasma spraying. In order to effect an increase in the strength of the interlamellae bonds, the present invention reduces the amount of oxidation which occurs during spraying through sarcifical oxidation of the carbide in the agglomerated molybdenum/dimolybdenum carbide powder.

In a preferred embodiment, the thermal spray powder of this invention is a blend of two component powders. The first powder is an agglomerated molybdenum/dimolybdenum carbide powder in which the carbon exists preferably in the form of dimolybdenum carbide ($Mo_2C$) precipitates uniformly dispersed in a molybdenum lattice. Such an agglomerated molybdenum/dimolybdenum carbide powder can be formed by an in situ process such as the one described in U.S. Pat. No. 4,716,019, the disclosure of which is incorporated herein by reference. The in situ process involves forming a slurry of molybdenum and carbon powders and an organic binder, spray drying the slurry to form agglomerates and then firing the agglomerates in a non-oxidizing atmosphere at a temperature high enough to form dimolybdenum carbide. The amount of dimolybdenum carbide in the agglomerated powder can be varied by changing the amount of carbon added to the slurry to make the composite powder. The preferred amount of dimolybdenum carbide in the powder ranges from about 20 to about 60 volume percent (vol. %) in the agglomerated composite powder.

The in situ process yields composite powders wherein the molybdenum and dimolybdenum carbide phases are uniformly distributed in each particle. The uniform dispersion of the dimolybdenum carbide phase in the agglomerated powder promotes uniform sacrificial oxidation of the carbide phase during plasma spraying which protects the molybdenum from oxidation. The sacrificial oxidation of the carbide phase leads to oxide-free molybdenum surfaces which improve the interlamellae bonding in the coating and thereby act to inhibit delamination during sliding contact. This in turn gives rise to stable frictional behavior for extended periods of sliding contact. Additionally, the strength of the molybdenum lamellae is increased because the molybdenum lamellae contain residual dimolybdenum carbide precipitates not consumed during plasma spraying.

Table 1 compares molybdenum powder with the agglomerated molybdenum/dimolybdenum carbide powder and coatings made therefrom. From the table, it can be seen that there is a substantial increase in the oxgen content of the molybdenum coating as a result of oxidation during plasma spraying, from 0.1 wt % to 1.1 wt. % $O_2$. However, for the coatings made from the agglomerated $Mo/Mo_2C$ powder, the increase in the oxygen content of the coating is substantially smaller, from 0.1 wt. % to 0.4 wt. % $O_2$. Furthermore, the applied coating made from the agglomerated $Mo/Mo_2C$ powder has less than 10 vol. % $Mo_2C$ showing that most of the carbide in the starting powder was consumed in the plasma spraying. The small amount of carbide retained in the coating yields the added benefit of increasing the strength and hardness of the molybdenum coating. The hardness of the applied coating formed from the agglomerated $Mo/Mo_2C$ powder is approximately 20% higher than the coating formed from the powder containing only molybdenum.

TABLE 1

| | Powder | | | Applied Coating | | | Cross |
|---|---|---|---|---|---|---|---|
| | wt. % C | vol. % $Mo_2C$ | wt. % $O_2$ | wt. % C | vol % $Mo_2C$ | wt. % $O_2$ | Section Hardness (VHN) |
| Mo | — | — | 0.1 | — | — | 1.1 | 370 |
| $Mo/Mo_2C$ | 3.2 | 55 | 0.1 | 1.1 | 9 | 0.4 | 450 |

Figure 4:
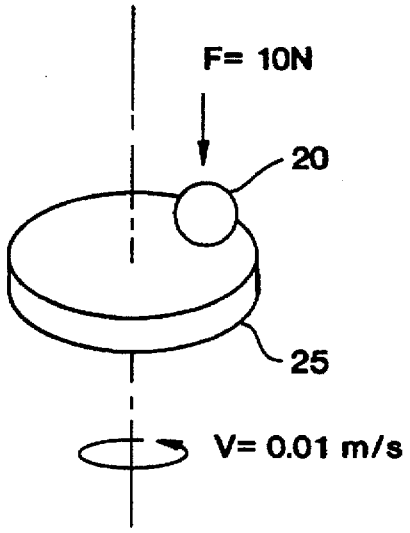
FIG. 4 is a schematic of the ball-on-disk tester used to measure the frictional characteristics of the thermal spray coatings.

Friction and wear tests were performed on a series of coatings made from agglomerated $Mo/Mo_2C$ powders and compared with the coating made from molybdenum powder. The test were performed using the ball-on-flat configuration and procedures described in H. Czichos, S. Becker and J. Lexow, "Multi-laboratory Tribotesting: Results from the Versailles Advanced Materials and Standards (VAMAS) Program on Wear Test Methods," *Wear*, vol. 114, pp. 109–130 (1987), the disclosure of which is herein incorporated by reference. A schematic of the ball-on-disk tester used is shown in FIG. 4. The coatings were polished prior to testing to achieve flat surfaces. The measurements were carried out in air with a stationary AISI 440-C steel ball (9.5 mm diameter) 20 mated against the rotating plasma coated disk 25 with a force of 10N. The steel ball 20 had a minimum hardness of $R_c$ 58. The disk 25 was rotated about its axis at a velocity of 0.01 m/s to produce a 10 mm wear track diameter. The results of the friction tests on the Mo and $Mo/Mo_2C$ coatings are shown in FIG. 2.

Figure 2:
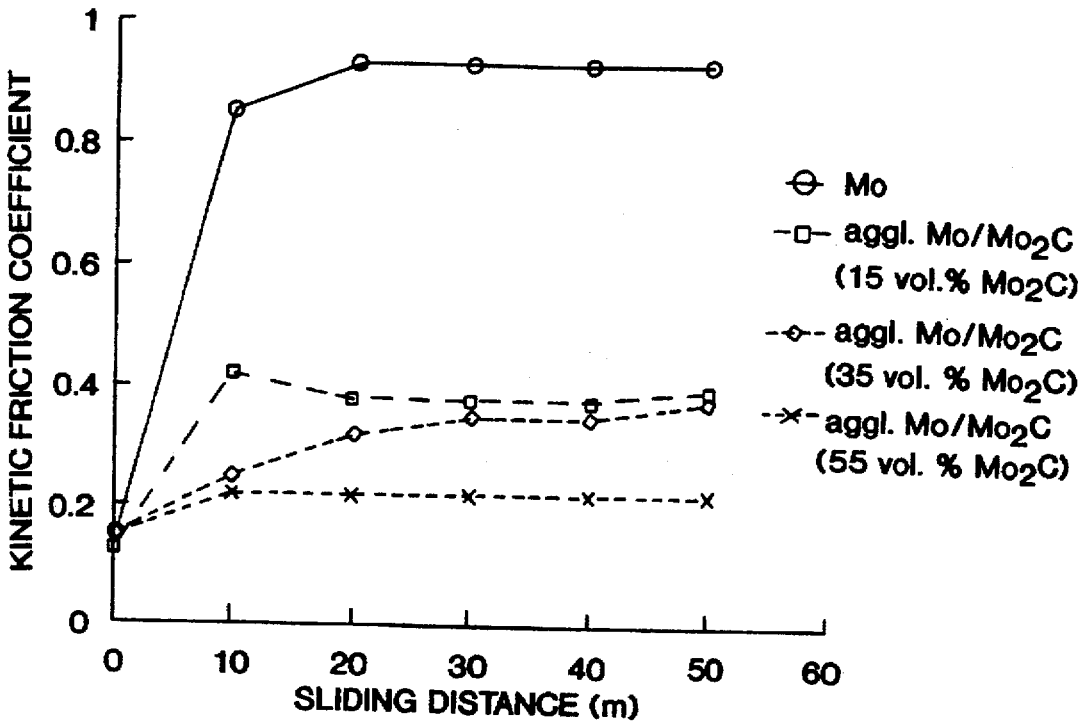
FIG. 2 is a graph comparing the friction characteristics of plasma sprayed coatings made from molybdenum powder and agglomerated molybdenum/dimolybdenum carbide powders having different amounts of $Mo_2C$.

FIG. 2 shows that plasma sprayed coatings made from the agglomerated $Mo/Mo_2C$ composite powders exhibit lower coefficients of friction than the coating made from molybdenum powder. After a sliding distance of about 20 m, the kinetic friction coefficient of the coating made from only molybdenum powder stabilizes at about 0.9 whereas the kinetic friction coefficents for the coatings made from the agglomerated $Mo/Mo_2C$ powder are less than 0.4. Furthermore, the higher the $Mo_2C$ content of the agglomerated powder the lower the kinetic friction coefficient of the coating. For example, at the 20 m sliding distance, the kinetic friction coefficients decrease from about 0.4 to about 0.2 when the $Mo_2C$ content of the agglomerated powder is increased from 15 to 55 volume percent. It is important to note that the amount of $Mo_2C$ in the coating is less than 10 vol. %.

The second component of the thermal spray powder of this invention is a self-fluxing NiCrFeBSi alloy powder. These alloys typically contain from about 5 to 15 wt. % Cr, from about 3 to 6 wt. % Fe, from about 2 to 5 wt. % B, from about 3 to 6 wt. % Si, from about 0.3 to 2 wt. % C and balance Ni. The B and Si components of the self fluxing alloy act as deoxidizers imparting the self fluxing properties to the alloy. Powders of this alloy are produced by gas atomization and are available from Culox Technologies of Naugatuck, Connecticut and Sulzer Plasma-Technik of Troy, Mich. A comparison between a preferred NiCrFeBSi alloy and 80/20 NiCr alloy is shown in Table 2. It can be seen from the comparison that the NiCrFeBSi self fluxing alloy used in invention is a high hardness material having relatively low ductility whereas the 80/20 NiCr alloy used in other spray powders is a relatively low hardness material having a high ductility. The high hardness of the NiCrFeBSi self-fluxing alloy is a significant factor in producing a coating having a high wear resistance.

TABLE 2

| | NiCr | | NiCrFeBSi | |
|---|---|---|---|---|
| | Weight % | Atomic % | Weight % | Atomic % |
| Ni | 80.0 | 77.7 | 73.5 | 59.3 |
| Cr | 20.0 | 22.3 | 13.6 | 12.3 |
| Fe | — | — | 4.4 | 3.7 |
| B | — | — | 3.3 | 14.2 |
| Si | — | — | 4.4 | 7.5 |
| C | — | — | 0.8 | 3.0 |
| Total | 100.0% | 100.0% | 100.0% | 100.0% |
| Density (g/cc) | 8.6 | | 7.8 | |
| Melting Point | 1400° C. | | 975° C. | |
| Hardness (DPH) | 150–200 | | 710–790 | |
| Ductility (Toughness) | High | | Low | |
| Phases | Ni solid solution | | Ni solid solution + $Ni_3B$ + $CrB_2$, $Cr_3Si$, $Fe_2Ni_2B$ | |

In making the present invention, the blend ratio between the agglomerated $Mo/Mo_2C$ and NiCrFeBSi powders is adjusted to meet the hardness and wear resistance requirements of the particular application. For example, for severe wear environments, the NiCrFeBSi component is increased up to 50 wt. %. The preferred composition range of the thermal spray powder is from about 10 wt. % to about 50 wt. % NiCrFeBSi and from about 90 wt. % to about 50 wt. % agglomerated $Mo/Mo_2C$. A more preferred range is between about 20 wt. % to about 32 wt. % NiCrFeBSi and from about 80 wt. % to about 68 wt. % agglomerated $Mo/Mo_2$.

The following non-limiting examples are presented.

A self fluxing NiCrFeBSi allow powder having the composition 73.5 wt. % Ni, 13.6 wt. % Cr, 4.4 wt. % Fe, 3.3 wt. % B, 4.4 wt. % Si, and 0.8 wt. % C was combined in the following proportions with an agglomerated $Mo/Mo_2$ powder having 55 vol. % $Mo_2C$. The composition in Example 3 is typical of the thermal spray powders currently in use in the industry.

EXAMPLE 1

80 weight percent agglomerated $Mo/Mo_2C$ powder 20 weight percent NiCrFeBSi alloy powder

EXAMPLE 2

68 weight percent agglomerated $Mo/Mo_2C$ alloy powder 32 weight percent NiCrFeBSi powder

EXAMPLE 3

Same as Example 2, except 68 weight percent of a molybdenum powder was used in place of the agglomerated $Mo/Mo_2C$ powder.

Table 3 shows the results of hardness tests conducted on the coatings made with the thermal spray powders of examples 1–3. These results are compared with reported data on a coating made from a $Mo/Mo_2C$/NiCr thermal spray powder. With respect to cross section hardness, the tests show that coatings 1 and 2 made with the thermal spray powders of this invention are at least 55% harder than coating 3 and at least 140% harder than coating 4 which contains NiCr. The data also shows that, for the powders of this invention, the higher the percentage of the self-fluxing alloy, the higher the hardness of the coating. Coatings 1 and 2 also exhibited greater wear resistance than the typical industry coating 3 and further exhibited the characteristics associated good sprayability and resistance to coating break out failures, including delamination.

TABLE 3

| Blend Composition | Surface Hardness ($R_C$) | Cross Section Hardness (VHN) | Wear Resistance |
|---|---|---|---|
| 1 aggl. $Mo/Mo_2C$ & 20 wt. % NiCrFeBSi | 51 | 900 | High |
| 2 aggl. $Mo/Mo_2C$ & 32 wt. % NiCrFeBSi | 54 | 920 | High |
| 3 Mo & 32 wt. % NiCrFeBSi | 39 | 580 | Moderate |
| 4 $Mo/Mo_2C$/NiCr | — | 370* | — |

*U.Buran and M.Fischer, "Properties of Plasma Spray Coatings for Piston Ring Running Surfaces," 1st Plasma-Technik-Symposium, Lucerne, Switzerland, (May 18–20 1988).

Figure 3:
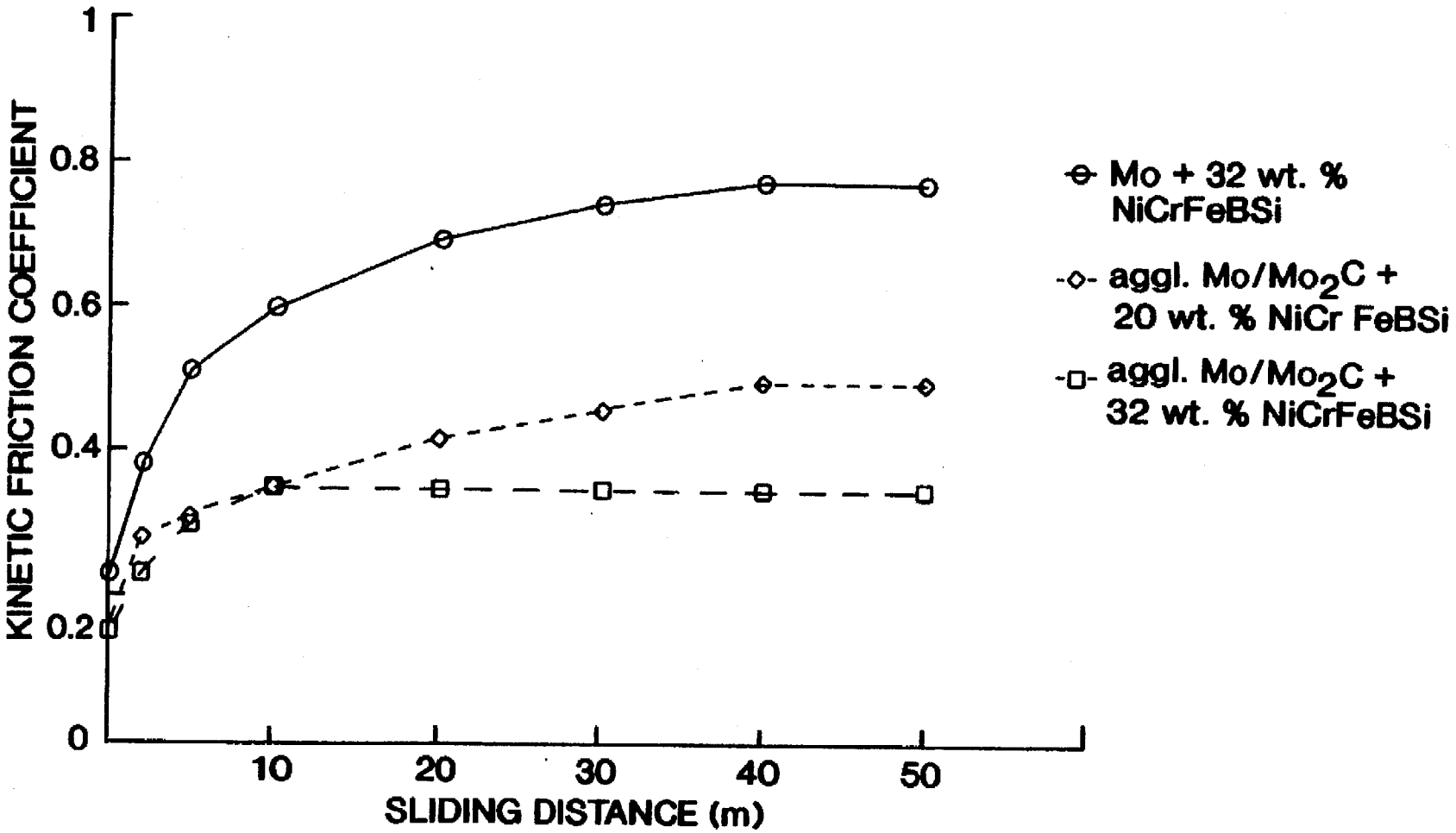
FIG. 3 is a graph comparing the friction characteristics of coatings made from various thermal spray powders.

FIG. 3 is a graph of the friction behavior of the coatings made with the thermal spray powders of examples 1–3 as measured using the ball-on-disk tester previously described. FIG. 3 shows that the coatings made with the thermal spray powders of this invention containing the agglomerated $Mo/Mo_2C$ powder exhibit relatively low coefficients of friction in comparison to the typical industry coating which is made from thermal spray powders containing molybdenum powder. After a sliding distance of 50 m, the kinetic friction coefficient for the Mo/NiCrFeBSi coating is about 0.8 whereas the kinetic friction coefficients for the agglomerated $Mo/Mo_2C$ plus NiCrFeBSi coatings are less than about 0.5. The data further shows that lower kinetic friction coefficients are obtained at higher percentages of the self-fluxing alloy in the powders containing agglomerated $Mo/Mo_2$. For example, at the 50 m sliding distance, the kinetic coefficient decreases from about 0.5 to about 0.35 when the amount of NiCrFeBSi alloy is increased from 20 to 32 wt. %.

Thus, it has been shown that the thermal spray powders of this invention can be used to produce high hardness, low friction, wear resistant coatings which are resistant to coating breakout failures and exhibit the requisite characteristics of sprayability needed for applications such as piston ring coatings.

Minor amounts of other materials may also be added to these thermal spray powders to enhance the hardness and wear resistance of the applied coatings. For applications involving hardened steel cylinder liners, it may be advantageous to add up to 10 wt. % of a high hardness material such as chromium carbide to increase wear resistance.

For example, a thermal spray powder having the designation SX-378 was prepared by blending 65 wt. % of an agglomerated $Mo/Mo_2$powder having 35 vol. % $Mo_2C$ (SX-276, available from OSRAM SYLVANIA Inc. of Towanda, Pa.) , 25 wt. % of a NiCrFeBSi alloy powder similar to that used in Examples 1–3, and 10 wt. % of a chromium carbide/nichrome alloy powder having 75 wt. % $Cr_3C_2$ and 25 wt. % 80/20 NiCr (SX-195, also available from OSRAM SYLVANIA Inc.). The SX-378 spray powder was plasma sprayed onto a mild steel substrate with a Plasma Technik F4 plasma spray system using the parameters described in table 4.

TABLE 4

| Gun | PT-F4 |
|---|---|
| Nozzle | 1.8 mm |
| Current | 500 Amps |
| Voltage | 69 Volts |
| Primary (Ar) | 40 slpm |
| Secondary ($H_2$) | 10 slpm |
| Carrier (Ar) | 2.5 slpm |
| Feedrate | 35 g/m |
| Spray Distance | 100 mm |

The SX-378 coating was then compared with a coating prepared from a 68/32 Mo/NiCrFeBSi thermal spray powder (as in Example 3), designated SA-901, sprayed under similar conditions.

Hardness measurements determined that the SX-378 coating was considerably harder than the SA-901B coating. The SX-378 coating had a superficial hardness of 56 $R_c$ and a microhardness of 773 $DPH_{300}$, whereas the SA-901B coating had a superficial hardness of 46 $R_c$ and a microhardness of 484 $DPH_{300}$. Friction and wear tests conducted on a Falex modified ball-on-disk tester using a 40N load at 0.05 m/sec showed that the SX-378 coating had better frictional properties and wear characteristics than the SA-901B coating. The friction coefficient for the SA-901B coating was about 0.63 at 300 seconds compared with about 0.57 at 300 seconds for the SX-378 coating. An examination of optical micrographs of the worn surfaces found a smaller wear track on the SX-378 coating and much less delamination wear compared to the SA-901B. The SA-901B coating exhibited particle pull-out, gouging and non-uniform wear whereas the SX-378 coating showed polishing wear and limited particle pull-out.

While there has been shown and described what are at the present considered the preferred embodiments of the invention, it will be obvious to those skilled in the art that various changes and modifications may be made therein without departing from the scope of the invention as defined by the appended claims.

I claim:

1. A thermal spray powder comprising a blend of an agglomerated molybdenum/dimolybdenum carbide powder and a self-fluxing NiCrFeBSi alloy powder.

2. The thermal spray powder of claim 1 wherein the agglomerated powder contains from about 20 to about 60 vol. % of dimolybdenum carbide.

3. The thermal spray powder of claim 1 wherein the blend contains from about 10 to about 50 wt. % of the self-fluxing NiCrFeBSi alloy.

4. The thermal spray powder of claim 1 wherein the NiCrFeBSi alloy has a composition of from about 5 to 15 wt. % Cr, from about 3 to 6 wt. % Fe, from about 2 to 5 wt. % B, from about 3 to 6 wt, % Si, from about 0.3 to 2 wt. % C and balance of Ni.

5. A thermal spray powder comprising a blend of an agglomerated molybdenum/dimolybdenum carbide powder and a self-fluxing NiCrFeBSi alloy powder, the agglomerated molybdenum/dimolybdenum carbide powder having particles containing a uniformly distributed dimolybdenum carbide phase.

6. The thermal spray powder of claim 5 wherein the agglomerated powder contains from about 20 to about 60 vol. % of dimolybdenum carbide.

7. The thermal spray powder of claim 5 wherein the blend contains from about 10 to about 50 wt. % of the self-fluxing NiCrFeBSi alloy.

8. The thermal spray powder of claim 5 wherein the blend further contains up to about 10 wt. % of a chromium carbide alloy.

9. The thermal spray powder of claim 8 wherein the blend contains about 10 wt. % of a chromium carbide/nichrome alloy having 75 wt. % $Cr_2C_3$ and 25 wt. % 80/20 NiCr.

10. The thermal spray powder of claim 5 wherein the NiCrFeBSi alloy has a composition of from about 5 to 15 wt. % Cr, from about 3 to 6 wt. % Fe, from about 2 to 5 wt. % B, from about 3 to 6 wt, % Si, from about 0.3 to 2 wt. % C and balance of Ni.

11. The thermal spray powder of claim 5 wherein the uniformly distributed dimolybdenum carbide phase sacrificially oxidizes during thermal spraying.

* * * * *